US008052842B2

(12) United States Patent
Pittman et al.

(10) Patent No.: US 8,052,842 B2
(45) Date of Patent: Nov. 8, 2011

(54) METHOD FOR MAKING A COMPRESSED STRUCTURAL FIBERBOARD

(75) Inventors: Paul H. Pittman, Muldane, KS (US); David Bochna G. Pyles, Vernon, TX (US)

(73) Assignee: Agriboard Industries, Wichita, KS (US)

( * ) Notice: Subject to any disclaimer, the term of this patent is extended or adjusted under 35 U.S.C. 154(b) by 856 days.

(21) Appl. No.: 12/019,389

(22) Filed: Jan. 24, 2008

(65) Prior Publication Data

US 2009/0188642 A1 Jul. 30, 2009

(51) Int. Cl.
*D21F 13/00* (2006.01)

(52) U.S. Cl. ..... 162/225; 241/24.1; 241/24.29; 241/28

(58) Field of Classification Search ..... 162/24, 162/225; 264/109; 241/24.1, 28, 24.29
See application file for complete search history.

(56) References Cited

U.S. PATENT DOCUMENTS

| | | | | | |
|---|---|---|---|---|---|
| 3,064,357 | A | * | 11/1962 | Butters | 34/560 |
| 3,890,077 | A | | 6/1975 | Holman | |
| 3,967,912 | A | * | 7/1976 | Parker | 404/84.05 |
| 4,025,278 | A | | 5/1977 | Tilby | |
| 4,212,616 | A | | 7/1980 | Tilby | |
| 4,451,322 | A | | 5/1984 | Dvorak | |
| 5,413,746 | A | | 5/1995 | Birjukov | |
| 5,459,318 | A | | 10/1995 | Cacho | |
| 5,498,478 | A | | 3/1996 | Hansen et al. | |
| 5,730,830 | A | | 3/1998 | Hall | |
| 5,945,132 | A | | 8/1999 | Sullivan et al. | |
| 6,143,220 | A | | 11/2000 | Sullivan et al. | |
| 6,346,165 | B1 | | 2/2002 | Markessini | |
| 6,546,986 | B1 | | 4/2003 | Waggoner et al. | |
| 2007/0049661 | A1 | * | 3/2007 | Neel et al. | 524/27 |

FOREIGN PATENT DOCUMENTS

| | | | | |
|---|---|---|---|---|
| DE | 40 34 610 | A1 | | 5/1992 |
| DE | 10 2006 004779 | A1 | | 8/2007 |
| DE | 10 2006 055116 | A1 | | 5/2008 |
| EP | 0 908 281 | A | | 4/1999 |
| GB | 990 361 | A | | 4/1965 |
| SU | 650832 | A | * | 3/1979 |
| SU | 1020251 | A | * | 5/1983 |
| WO | 02/059433 | A | | 8/2002 |

OTHER PUBLICATIONS

Derwent Abstract of SU-1020251 A, 1983.*
Derwent Abstract of SU-650832 A, 1979.*

* cited by examiner

*Primary Examiner* — Eric Hug
*Assistant Examiner* — Dennis Cordray
(74) *Attorney, Agent, or Firm* — Young Basile Hanlon & MacFarlane, P.C.

(57) ABSTRACT

An improved method for making compressed structural fiberboard by extruding agricultural fibrous matter into a compressed structural fiberboard. The improved method includes providing a preselected volume of agricultural fibrous matter and preconditioning the agricultural fibrous matter to have a predetermined moisture level. The agricultural fibrous matter is separated and cleaned, and steam is added until a predetermined level of moisture is reached within the agricultural fibrous matter. Borax is also added to the agricultural fibrous matter to prevent the formation of bacteria. The agricultural fibrous matter is conveyed throughout the process on conveyors having variable drives, wherein the level of the agricultural fibrous matter on the conveyors is sensed such that a signal is provided to adjust the speed of the conveyors in order to provide a predetermined level of agricultural fibrous matter. The agricultural fibrous matter is then extruded to form a compressed structural fiberboard.

21 Claims, 7 Drawing Sheets

METHOD FOR MAKING A COMPRESSED STRUCTURAL FIBERBOARD

FIELD OF THE INVENTION

The present invention relates to architectural structural materials and, more particularly, to an improved method for compressing agricultural fibrous matter, such as straw, wherein certain processing levels, such as moisture content, are monitored and adjusted to provide a more efficient and consistent load-bearing and insulating panel for making a compressed structural fiberboard usable in the building industry.

BACKGROUND OF THE INVENTION

Mankind has been intrigued for many years with the concept of using waste agricultural products, such as straw, to build relatively permanent domiciles and other generally permanent buildings. This concept includes replacing typical floors, wooden or metal stud walls, and ceilings and roof constructions normally used for on-site fabrication with panel boards made from agricultural fibers. The panel boards of this nature made in the past have had the structural and insulation properties of the conventional structures that they replaced.

Although the basic concept has been around for some time, various anomalies have prevented the commercial dominance of this concept over standard approaches. For instance, in the past, it has been difficult to manufacture such agricultural fiberboards that have a reliable and consistent density in the core of the fiberboard. In addition, the relatively high cost of manufacturing such a fiberboard was also a considerable problem.

Applicant resolved the problems of the past by inventing a method and apparatus for making compressed agricultural fiber structural board, as seen and disclosed in U.S. Pat. Nos. 5,945,132 and 6,143,220. Although the inventions described in the above-noted patents led to the creation of a relatively low-cost fiberboard having a core with a substantially consistent density, it was determined that certain inconsistencies and inefficiencies were leading to rather large variances in the quality and the cost of the fiberboard. For instance, the straw utilized to create the fiberboard contains various moisture levels depending on the type of straw and the time of year in which the straw is harvested. Since moisture is a key factor in the resulting density of the core of the fiberboard, the failure to control the moisture level in the straw prior to and during the fiberboard manufacturing process led to undesirable variances in the density of the core of the fiberboard. In addition, due to the structural integrity of straw, it is often difficult to provide a consistent amount of straw throughout the process once the straw is separated and cleaned. Failure to provide a consistent amount of straw throughout the process may lead to inconsistencies in the density of the fiberboard. These and other various processing factors have lead to certain inconsistencies and inefficiencies that are undesirable in a manufacturing environment.

SUMMARY OF THE INVENTION

The present invention provides an improved method for making a compressed structural fiberboard, wherein an agricultural fibrous matter is extruded to form the compressed structural fiberboard. The improved method of the present invention provides the steps of providing a predetermined volume of the agricultural fibrous matter and preconditioning the agricultural fibrous material to obtain a predetermined level of moisture within the agricultural fibrous material. The agricultural fibrous material is then separated into individual pieces and cleaned to remove any foreign material and waste. Steam is added to the agricultural fibrous material to obtain a predetermined level of moisture in the agricultural fibrous material. A predetermined level of Borax is also added to the agricultural fibrous material to prevent the formation of bacteria in the agricultural fibrous material and in the compressed structural fiberboard. The agricultural fibrous material is then extruded to form a compressed structural fiberboard.

To precondition the agricultural fibrous material, the agricultural fibrous material may be allowed to dry at ambient temperatures until a predetermined level of moisture is obtained in the agricultural fibrous matter prior to introducing the agricultural fibrous matter into the process of manufacturing the compressed structural fiberboard. Alternatively, the agricultural fibrous matter may be placed in a dehumidifier or oven in order to obtain a predetermined level of moisture in the agricultural fibrous matter prior to introducing the agricultural fibrous matter into the process of manufacturing the compressed structural fiberboard.

During the separation and cleaning of the agricultural fibrous material, the agricultural fibrous matter is separated by a flake separator, and foreign particles and waste are separated from the agricultural fibrous matter by straw walkers. The waste and foreign material is vacuumed by a vacuum system and directed to a holding vessel. The vacuumed waste and foreign material may be recycled by filtering smaller pieces of the agricultural fibrous material from the foreign material and waste and reintroducing such agricultural fibrous material back into the manufacturing process. The remaining waste and foreign material from the agricultural fibrous material may be disposed accordingly. The larger pieces of agricultural fibrous material are then broken down by a shredder.

The improved method of the present invention includes applying steam and borax to the agricultural fibrous matter within an enclosure. Infrared moisturizing sensors may be mounted within the enclosure to monitor the moisture level in the agricultural fibrous material. The enclosure may comprise a substantially rectangular enclosure having a conveyor passing therethrough, or the enclosure may comprise a tumbler for tumbling the agricultural fibrous matter.

The improved method of the present invention may provide variable speed conveyor belts for transporting the agricultural fibrous material to the extruder. The method may include the steps of providing proximity switches along the conveyor belt to monitor the height of the agricultural fibrous matter while providing a signal when the agricultural fibrous matter does not meet a predetermined height. The method further includes the step of adjusting the variable speed of the conveyor in response to the signal provided by the proximity switches in order that a proper level of agricultural fibrous material is provided.

The improved method of the present invention may include the steps of providing a reciprocating ram extruder for extruding the agricultural fibrous material into the compacted core of the fiberboard. In an alternative embodiment, a screw extruder may be utilized for extruding the agricultural fibrous matter into the compacted core of the fiberboard. The steps may further include applying heat to the agricultural fibrous material after the agricultural fibrous material is extruded into the compressed fiberboard. The invention may include wrapping containment material around the compacted fiberboard and cooling the fiberboard after applying the heat. The containment material may comprise industrial packing paper, or the containment material may comprise a lightweight, high-strength, mesh material. The cooling of the fiberboard may occur by providing electrical fans for blowing air on the fiberboard. In addition, the cooling of the fiberboard may occur by providing an enclosed refrigerated chamber for cooling the fiberboard.

The improved method of the present invention may include the steps of cutting the compressed structural fiberboard into predetermined lengths while maintaining pressure on the ends of the cut compressed structural fiberboard so that the ends of the compressed structural fiberboard may be capped with a containment material.

BRIEF DESCRIPTION OF THE DRAWINGS

The description herein makes reference to the accompanying drawings wherein like-referenced numerals refer to like parts throughout several views and wherein.

DETAILED DESCRIPTION OF THE EMBODIMENTS

Figure 1:
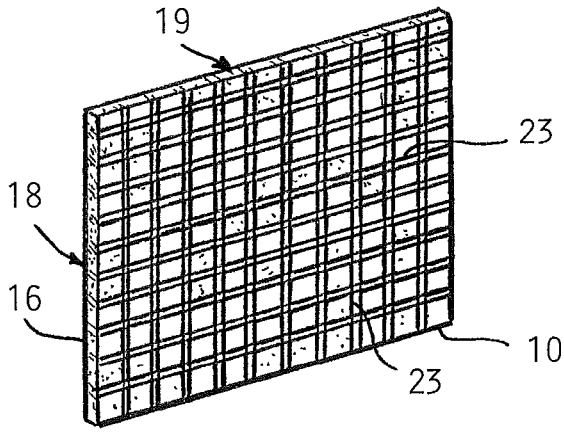
FIG. 1 is a perspective view of a compressed structural fiberboard of the present invention, wherein the containment material is a lightweight, high-strength, mesh material.

Referring to the drawings, the present invention will now be described in detail with reference to the disclosed embodiment.

Figure 2:
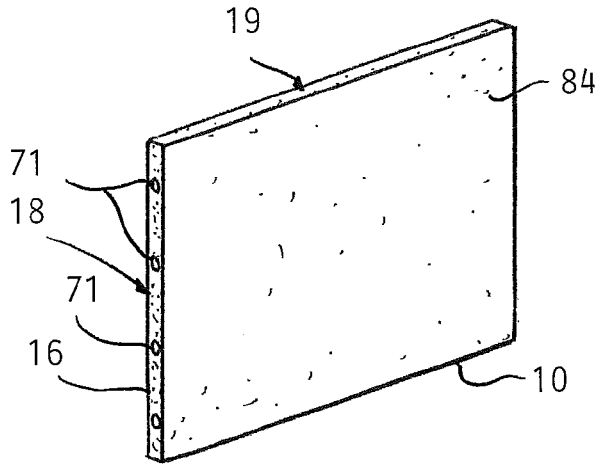
FIG. 2 is a perspective view of the compressed structural fiberboard of the present invention, wherein the containment material is an industrial packing paper.

The present invention provides an improved method for making a compressed structural fiberboard 10 from an agricultural fibrous material, such as straw 16, as seen in FIGS. 1-2. Such compressed structural fiberboard 10 may be utilized to construct various buildings, including domiciles. Various cladding may be used in combination with the compressed structural fiberboard 10 to allow the compressed structural fiberboard 10 to be used as either an exterior or interior panel of a building.

The compressed structural fiberboard 10 has many properties which allow it to be used as a building panel. For example, the compressed structural fiberboard 10 may be load-bearing while also providing for thermal and sound insulation. In addition, the compressed structural fiberboard 10 may be used to make filler panels for post- and beam-types of construction. Compressed structural fiberboard 10 may be fabricated into various thicknesses, lengths, and widths, depending on the application of the fiberboard 10. In addition, a range of densities can also be utilized in constructing the fiberboard 10.

Figure 3:
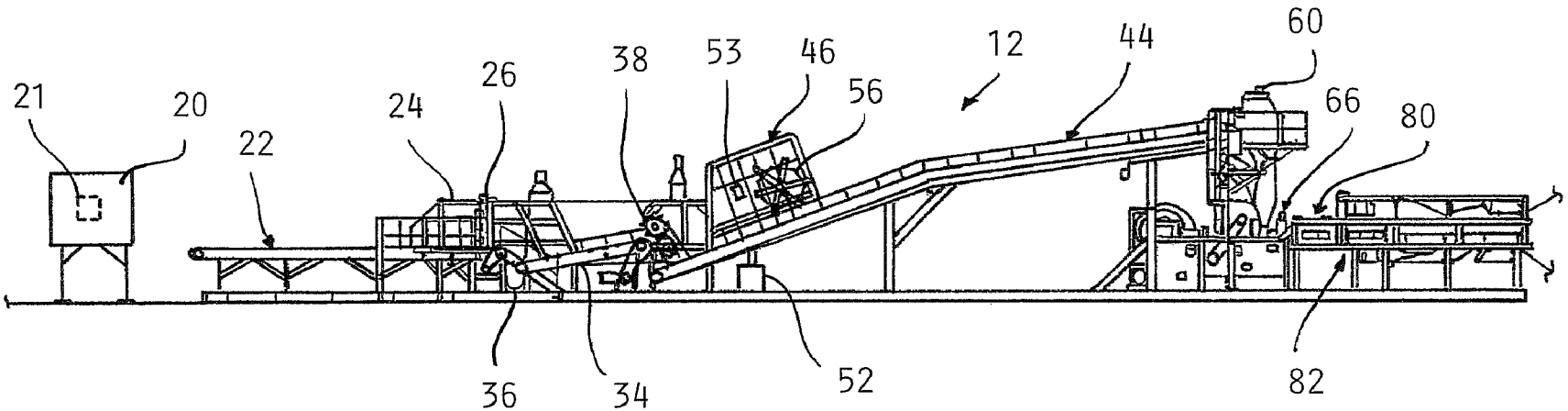
FIG. 3 is a side view of a first half of the mill utilized to produce the improved method for making a compressed structural fiberboard of the present invention.
Figure 4:
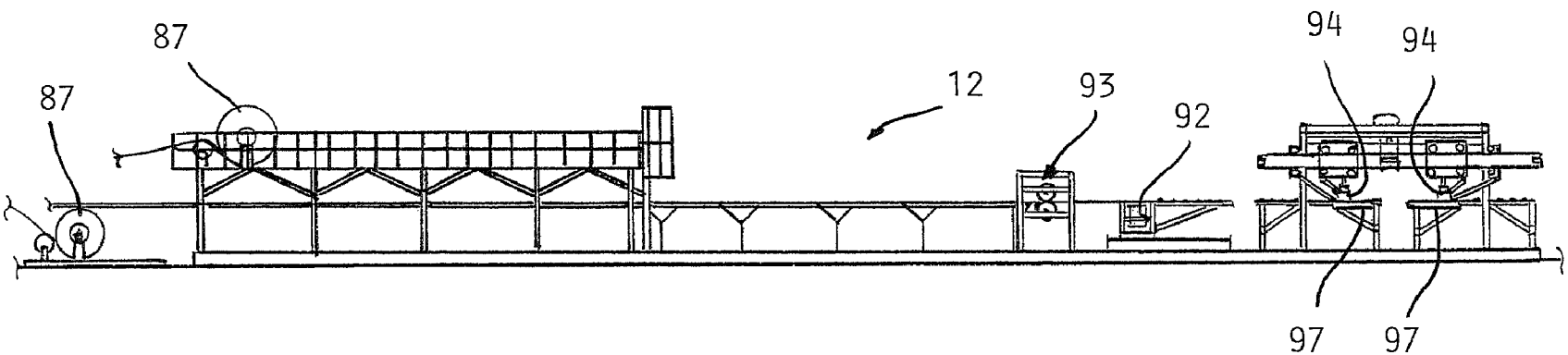
FIG. 4 is a side view of a second half of the mill utilized to produce the improved method for making a compressed structural fiberboard of the present invention.

As previously mentioned, the present invention relates to improvements to Applicant's previous method and apparatus for making the compressed structural fiberboard 10. FIGS. 3-4 show an overall view of a first half and a second half of a mill 12, respectively, which incorporates the improved method of the present invention for producing the compressed structural fiberboard 10. The mill 12 of the present invention is designed for use with bales 14 of cereal straw 16 or the like, but it will be recognized by those skilled in the art that there are agricultural products, both waste and products grown for the specific purpose of being converted into a building structural board, that can provide agricultural fibrous matter for the present invention. Other agricultural materials contemplated for use with the invention include straw from other primary protein products, such as wheat, barley, oats, and rice. It is also contemplated that the invention can be used with materials other than straw, such as sugarcane, bagasse, coconut husk, Johnson and switch grasses, etc. It has been determined through experimentation that bales 14 of straw 16 having individual pieces 10" or longer provide the most consistent compressed structural fiberboard 10. Bales 14 of straw 16 are provided in substantially 1,000 lb. bales, wherein one 1,000 lb. bale will produce a compressed structural fiberboard 10 having the dimensions 48"×4'×3.5". Since it has been determined that straw 16 is the most advantageous agricultural fibrous matter for the improved method of the present invention, straw 16 will be referred to as the agricultural fibrous matter throughout the subject specification.

The flow of the agricultural fibrous matter, such as straw 16, is from the first half of the mill 12, as seen in FIG. 3, to the second half of the mill 12, as seen in FIG. 4. The improved method of the present invention forms a compacted straw core 18 of the fiberboard 10, cases it in a containment material 19, slices it, and covers the ends with the same containment material 19 to produce the compressed structural fiberboard 10 of the present invention, as seen in FIGS. 1-2. The containment material 19 may include an industrial packing paper 84, such as Kraft liner paper, or the containment material 19 may include a lightweight, high-strength, mesh material 23 fabricated from a plastic or metal material.

Bales 14 of straw 16 or other agricultural product providing fiber for the compacted straw core 18 of the fiberboard 10 are first preconditioned to control the moisture content of the straw 16 prior to introducing the straw 16 into the mill 12. One way to control the moisture level within the straw 16 is to allow the straw 16 to properly dry in ambient air. When this occurs, the bales 14 of straw 16 are dried until the moisture content of the straw 16 is in a range between 11-15%. Due to the importance of the moisture level in the straw 16 in controlling the consistency and the quality of the finished compressed structural fiberboard 10, the moisture level in the straw 16 should be controlled to the tightest tolerance possible. Therefore, the moisture content of the air-dried straw 16 is first measured to ensure that it is in the range of 11-15% prior to entering the mill 12. If the moisture level is above this range, then the straw 16 is allowed to dry further until the specified range is reached. If the straw 16 is within the specified range of moisture, then the straw 16 may be introduced to the mill 12.

Alternatively, or in addition thereto, the present invention may provide a dehumidifier or oven 20 for preconditioning each bale 14 of straw 16 prior to entering the mill 12, as seen in FIG. 3. The bales 14 of straw 16 or other agricultural product may be delivered to the dehumidifier or oven 20 via a forklift, monorail, conveyor, etc. (not shown). The bales 14 of straw 16 may be placed in the dehumidifier or oven 20 in order to remove moisture from the bales 14 of straw 16 until the moisture content reaches a predetermined moisture level. The dehumidifier or oven 20 may contain infrared sensors 21 within the dehumidifier or oven 20 in order to monitor the moisture level within the straw 16. Alternatively, the moisture level can be measured manually so as to confirm that the moisture level within the straw 16 is at the desired level. By starting with a predetermined moisture level in the straw 16, the moisture level within the straw 16 can be thoroughly controlled throughout the process, thereby allowing for a more consistent and higher quality fiberboard 10.

Figure 5:
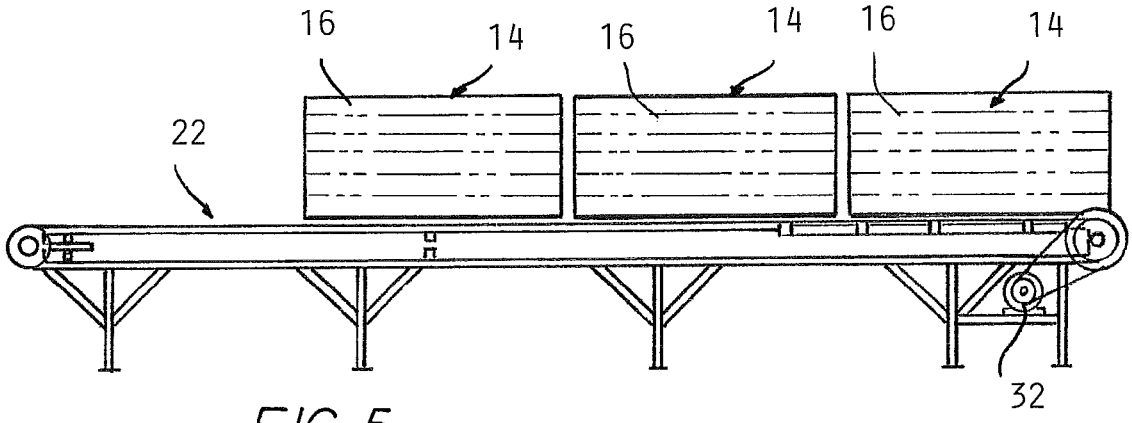
FIG. 5 is a side view of a bale conveyor utilized in the improved method for making a compressed structural fiberboard of the present invention.

Once the bales 14 of straw 16 are preconditioned, the bales 14 of straw 16 are transported to the start of a bale conveyor 22, as seen in FIGS. 3 and 5. Twine or other tying materials (not shown) which hold the bales 14 of straw 16 together are removed so that the bales 14 of straw 16 may be cleaned and separated. The bales 14 of straw 16 are placed on the bale conveyor 22 and delivered by the bale conveyor 22 to a housing 24. A flake separator 26 is disposed within the housing 24, and as the bales 14 of straw 16 are delivered to the flake separator 26 within the housing 24 by the bale conveyor 22, the flake separator 26 tears the bales 14 of straw 16 apart into individual pieces of straw fiber 16. The dust created by the process is contained with the housing 24 and is discharged away from the atmosphere ambient to the mill 12. The flake separator 26 includes a pair of counteracting rollers having teeth, which act to comb out the individual straw fibers 16 from the flakes. Previously, the flake separator 26 contained a holdback reel at the entrance of the flake separator 26 to ensure that the speed of movement of the straw fiber 16 matches that of the bale conveyor 22. As an improvement of the present invention, the holdback reel was removed from the entrance of the flake separator 26, and variable drives 32 have been added to the bale conveyor 22 to automatically adjust the speed of the bale conveyor 22. The variable drives 32 on the bale conveyor 22 are in communication with sensors further downstream of the mill 12 so as to adjust the amount of straw 16 being fed to the mill 12 through the speed of the bale conveyor 22.

Figure 6:
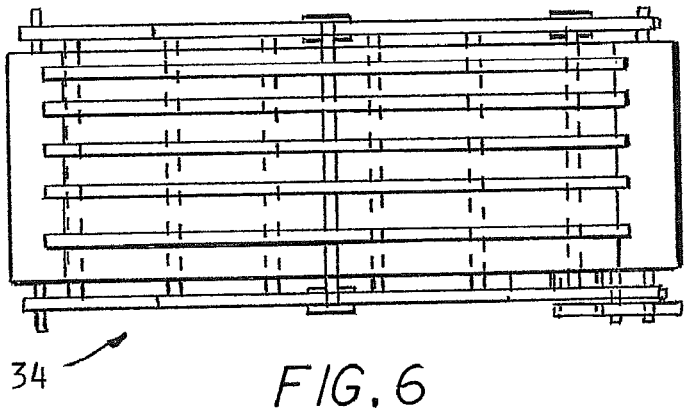
FIG. 6 is a top view of a straw walker utilized in the improved method for making a compressed structural fiberboard of the present invention.
Figure 7:
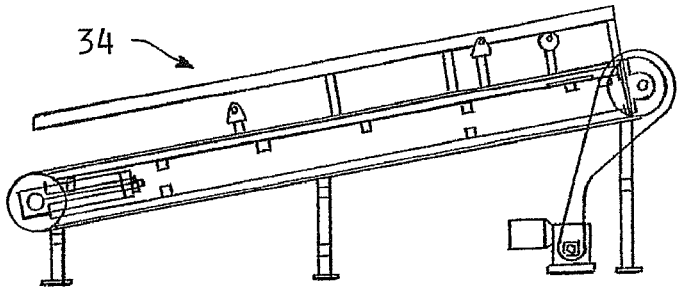
FIG. 7 is a side view of the straw walker utilized in the improved method for making a compressed structural fiberboard of the present invention.
Figure 9:
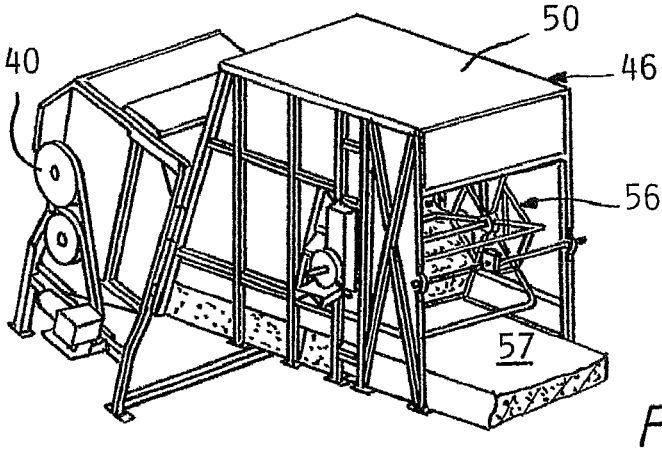
FIG. 9 is a perspective view of a shredder and a leveling reel utilized in the improved method for making a compressed structural fiberboard of the present invention.
Figure 10:
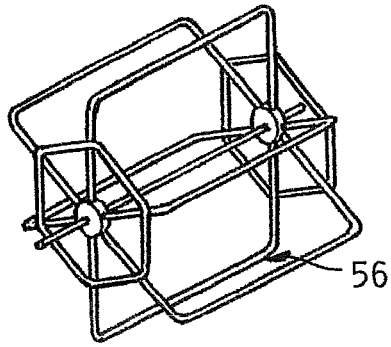
FIG. 10 is a perspective view of the leveling reel utilized in the improved method for making a compressed structural fiberboard of the present invention.

As a further improvement to the method for making compressed structural fiberboard 10, a conventional straw walker 34 is provided to remove foreign material and waste from the straw 16, as seen in FIG. 3 and 6-7. Although only one straw walker 34 is shown in the drawings, the present invention anticipates the use of a pair of straw walkers 34 mounted vertically adjacent one another in order to further clean and separate the straw 16. The straw walker 34 is mounted adjacent to the flake separator 26 so as to receive the shredded straw 16 from the flake separator 26. The straw walker 34 fluffs the straw fibers 16, separates the long and short straw fibers 16, and removes foreign material and waste from the straw 16, while the clean straw fibers 16 are further carried along the mill 12 by the straw walker 34. A vacuum system 36 vacuums the foreign material and waste that falls through the straw walker 34 and directs the foreign material and waste to a holding receptacle (not shown). The foreign material and waste may then be recycled by further filtering straw 16 from the foreign material and waste and reintroducing any straw fibers 16 that are discovered back into the mill 12 while discarding the remaining foreign material and waste. The remaining foreign material and waste may be utilized as fuel, livestock feed, landfill, etc. By further cleaning and recycling the straw 16, the compressed fiberboard 10 is of a higher quality, and the process is more efficient, as all aspects of the straw 16 are fully utilized.

In order to remove any clumps that may remain in the straw fibers 16 after passing through the straw walker 34, the straw fibers 16 are carried from the straw walker 34 to a shredder 38. The shredder 38 comprises a pair of cylindrical drums 40 having teeth 42 formed thereon, which comb through the straw fibers 16 to remove any remaining clumps of straw 16. The shredder 38 directs the straw fibers 16 onto a main conveyor 44, which carries the straw fibers 16 into an enclosure 46.

Immediately after the shredder 38, a plurality of proximity switches 48 may be mounted on the sides of the main conveyor 44. The proximity switches 48 sense the height of the straw fibers 16 being carried on the main conveyor 44, thereby determining whether a sufficient amount of straw fibers 16 are being fed to the mill 12. The proximity switches 48 provide a signal that is sent to the variable drives 32 on the bale conveyor 22 to speed or slow down the bale conveyor 22. This, in turn, may control the amount of straw fiber 16 being sent to the mill 12, as the slowing of the bale conveyor 22 allows more straw 16 to gather on the bale conveyor 22, while speeding of the bale conveyor 22 reduces the amount of straw 16 allowed to gather on the bale conveyor 22.

The enclosure 46 provides a conditioning chamber for treating the straw fibers 16 prior to extruding the straw fibers 16 into the fiberboard 10. The enclosure 46 may be a rectangular enclosure 50, as seen in FIG. 3, having the main conveyor 44 passing therethrough so as to enclose the straw fibers 16 on the main conveyor 44. Steam is applied to the straw fibers 16 within the enclosure 46 so as to provide the straw fiber 16 with a predetermined level of moisture. Previous designs have applied water through a mister, which often leads to the formation of mold and mildew on the straw 16, as the straw 16 has an outer coating that often does not allow for the absorption of water. Such mold and mildew may cause foul smells and bacterial growth that are undesirable for human housing. The application of steam and heat to the straw 16 has been found to be an improvement, as steam is absorbed into the straw 16 more efficiently than the application of water in a liquid or mist form. A steam generator 52 is mounted adjacent the enclosure 50 for providing steam to the straw fiber 16. At least one infrared moisturizer sensor 53 is mounted within the enclosure 50 to monitor the moisture content within the straw fibers 16. By monitoring the infrared moisturizer sensor 53, the amount of steam and heat applied to the straw fibers 16 within the enclosure 50 may be adjusted accordingly so as to provide a predetermined moisture level within the straw fibers 16.

To assist in prohibiting the formation of mold and/or mildew on the straw 16 and to distract the attraction of insects to the straw 16, borax is also applied to the straw fibers 16. One and a half ounces of borax is applied to every cubic foot of straw 16. The borax may be applied in a dry powder form, or the borax may be mixed with water and applied to the straw 16 with the steam. The application of the borax in combination with the steam has been found to be a more efficient method of applying the borax than the dry powder form, as the application of borax with steam provides a more consistent level of moisture throughout the straw fibers 16 and is less messy to control and clean than the dry powder form.

Figure 8:
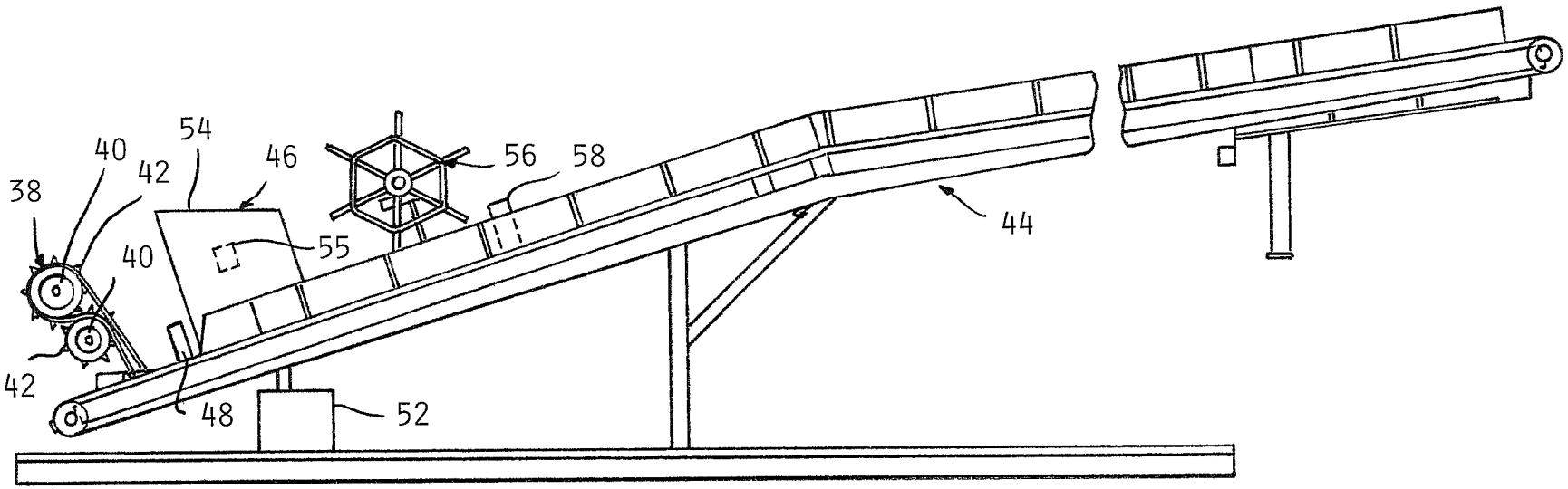
FIG. 8 is a side view of a main conveyor of the improved method for making a compressed structural fiberboard of the present invention.

In a separate embodiment, the enclosure 46 may comprise a tumbler 54, as seen in FIG. 8, utilized to apply the steam and the borax to the straw fibers 16. The tumbler 54 is similar to a conventional cement mixer, wherein the straw fibers 16 are delivered to the tumbler 54 via the main conveyor 44, are tumbled and mixed with the steam and borax, and are displaced from the tumbler 54 onto the main conveyor 44. The steam generator 52 is mounted adjacent the tumbler 54, and steam is directed to and applied within the tumbler 54. The tumbler 54 is an improvement over the rectangular enclosure 50, as it allows for more efficient and even-mixing of the steam and the borax to the straw fibers 16. At least one infrared moisturizer sensor 55 may be mounted within the tumbler 54 to provide an accurate measurement of the level of moisture in the straw fibers 16. A signal from the infrared moisturizer sensor 55 can be monitored to determine and adjust the level of moisture supplied to the tumbler 54 in order that the straw fibers 16 may reach a predetermined moisture level.

Upon exiting the enclosure 46, the main conveyor 44 carries the straw fiber 16 under a leveling reel 56, which assists in forming a substantially level mat 57 of the straw fibers 16, as seen in FIGS. 3 and 8-10. The leveling reel 56 rotates such that the straw mat 57 has a consistent height. It is to be noted that the height of the leveling reel 56 relative to the underlying main conveyor 44 can be adjusted via conventional approaches, such as by screw and block arrangement. The height of the mat 57 of straw fibers 16 exiting the leveling reel 56 may also be dependent on the amount of straw 16 that is being supplied to the leveling reel 56. Therefore, proximity switches 58 are mounted adjacent the sides of the main conveyor 44 immediately following the leveling reel 56 in order to sense the height of the mat 57 and thus, the level of the straw fibers 16 being carried on the main conveyor 44. The proximity switches 58 provide a signal to determine whether the mat 57 of straw fiber 16 has reached a predetermined height. The signal from the proximity switches 58 may then be sent to the variable drives 32 of the bale conveyor 22 to either increase or decrease the speed of the bale conveyor 22 so as to supply the leveling reel 56 with either a greater or lesser amount of straw 16. This ensures for a consistent height of the straw mat 57, thereby providing a consistent quantity of straw fibers 16, which assist in creating a consistent density of the compressed fiberboard 10.

Figure 11:
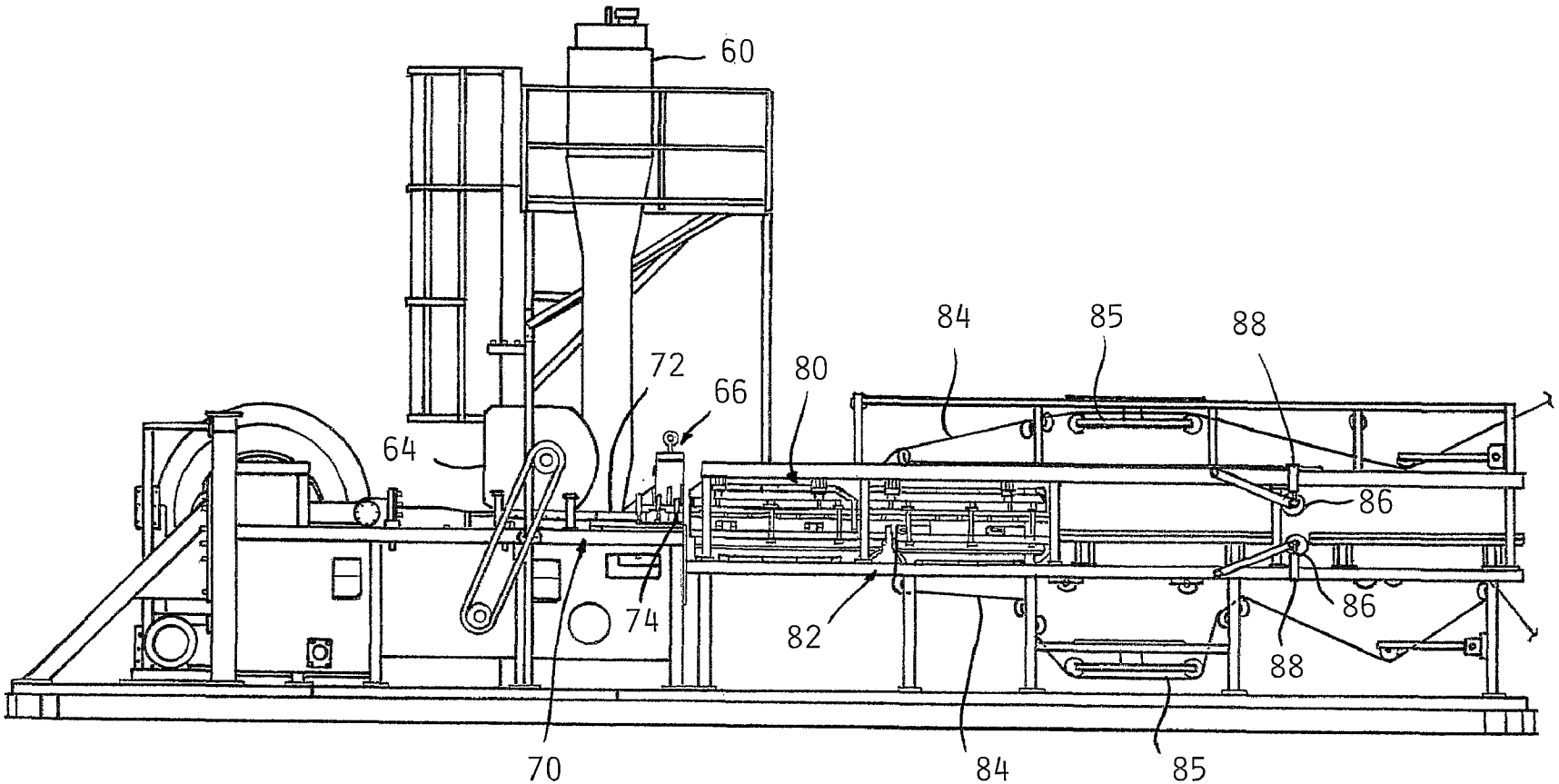
FIG. 11 is a side view of an extruder and heat platens utilized in the improved method for making a compressed structural fiberboard of the present invention.

In order to form a compacted straw core 18 for the fiberboard 10, the mat 57 of straw fiber 16 is carried from the leveling reel 56 up an incline of the main conveyor 44. The straw fiber 16 is carried into a chute 60, which is positioned at the end of the inclined main conveyor 44, as seen in FIGS. 3 and 11. A reel (not shown) located at the entrance of the chute 60 flings the mat 57 of straw fiber 16 against a wall of the chute 60 to thereby allow individual straw fibers 16 to fall a short distance to a packer 64. The packer 64 forces the straw fiber 16 further downward through the chute 60 in front of an extruder 66. Proximity switches (not shown) are placed within the chute 60 adjacent the packer 64 in order to determine the amount and density of straw fibers 16 being delivered to the extruder 66. The proximity switches provide a signal that is sent to the variable drives 32 on the bale conveyor 22, wherein the variable drives 32 may respond by slowing or increasing the speed of the bale conveyor 22. This, in turn, increases or decreases the quantity of straw fibers 16 being provided to the extruder 66.

To form the compacted straw core 18 for the compressed structural fiberboard 10, a continuous extrusion process is utilized that relies on heat and pressure to form the compacted straw core 18 of the fiberboard 10. The extruder 66 may comprise an oscillating ram extruder 70, wherein an oscillating ram 72 compacts the straw fibers 16 into an extrusion tunnel 74. As the oscillating ram 72 retracts on its return stroke, additional straw fibers 16 are fed into the extrusion tunnel 74 by the packer 64. The packer 64 is synchronized with the oscillating ram 72 of the extruder 70 such that the timed packer 64 forces straw fiber 16 into the space in front of the oscillating ram 72 prior to the oscillating ram 72 moving forward. The oscillating ram 72 moves forward on its forward stroke, thereby compacting the straw fibers 16 into the extrusion tunnel 74 and forcing the straw fibers 16 into a heated extrusion tunnel. The extrusion tunnel 74 has a substantially rectangular configuration that is substantially 3.5" high by 48" wide, which is the desired shape and size of the compacted straw core 18. The compacted straw fiber 16 takes the shape of the extrusion tunnel, as the oscillating ram compacts the straw fiber 16 into a substantially solid slab. The shape and size of the extrusion tunnel 74 may be adjusted in a conventional manner so that the size and shape of the compacted straw core 18 may be adjusted. The front of the oscillating ram 72 may include a plurality of pointed projections, which form holes 71 through the portion of the straw fiber 16 being compressed at the forming end of the compacted straw core 18. These holes 71 register with holes 71 in the previously-compacted straw fiber 16 making up the compacted straw core 18 so as to provide holes 71 extending throughout the length of the compacted straw core 18. These core holes 71 are provided in the center of the compacted straw core 18 for use as raceways for, example, electrical wiring or plumbing. They also are usable during the formation of the compacted straw core 18 to introduce a fluid, such as heated air, to the center of the compacted straw core 18. The number of these projections can be varied, depending upon the number of core holes 71 desired.

Typical agricultural fiber, such as straw 16, is comprised of a bundle of cellulose strands or fibers that are held together by a natural binder or adhesive called lignin. Lignin behaves much like a conventional thermoplastic, wherein the lignin softens when heated and hardens when cooled. This allows the straw fibers 16 to essentially be shaped into a particular configuration when heated and cooled. Thus, when the straw fiber 16 is compacted into the extrusion tunnel 74, the extrusion tunnel 74 heats the straw fiber 16 to approximately 360°-400° Fahrenheit so as to soften the lignin in the straw fiber 16, thereby allowing the straw fiber 16 to relax and take the shape of the extrusion tunnel 74. As the straw fiber 16 is passed out of the exit end of the extrusion tunnel 74, the straw fiber 16 cools, causing the slab of compressed straw core to maintain the shape of the extrusion tunnel 74, thereby creating a "new memory" for the straw fiber 16. There is no need for any other adhesive or resin to be applied other than the natural lignin that is already inherent within the straw fibers 16 to maintain the shape of the extrusion tunnel 74.

In an alternative extrusion process, the present invention may utilize a conventional screw extruder (not shown) as the extruder 66 for extruding the straw fiber 16 through the extrusion tunnel 74. The screw extruder utilizes a large threaded screw, which extends from the entry of the extrusion tunnel 74 into and within the extrusion tunnel 74. The screw extruder is allowed to continually rotate in a fixed position such that the straw fibers 16 are fed into the threads of the screw extruder at a continual rate. Thus, the oscillating packer 64 is no longer required. As the screw extruder rotates, the straw fibers 16 are driven forward into the extrusion tunnel 74. The straw fibers 16 are compacted into the extrusion tunnel 74 and are further pushed through a smaller portion of the extrusion tunnel 74 as the screw extruder continues to rotate, thereby creating a compacted slab of straw fiber 16. The extrusion tunnel 74 is heated in the same manner as previously described, and thus, the straw fiber 16 takes on the form of the extrusion tunnel 74 in the same way as previously described. The screw extruder is a more efficient extrusion process than the oscillating ram extruder 70, as the screw extruder may extrude the straw fibers 16 at a higher speed than the oscillating ram extruder 70, thereby providing a greater output in the same or shorter amount of time. In addition, the screw extruder provides less moving parts than the oscillating ram extruder 70, thereby requiring less maintenance than the oscillating ram extruder 70. Lastly, the screw extruder provides a more even flow of material, i.e., straw fiber 16, thereby providing a method wherein the density of the compacted straw core 18 of the fiberboard 10 is easier to control.

From the extrusion chamber, the compacted straw core 18 enters a first set of two heat platens 80 that heat both the top and bottom surfaces of the compacted straw core 18, as seen in FIGS. 3 and 11. The introduction of heat causes the straw 16 to become malleable with the steam that was introduced earlier in the process. The temperature of the heat platens 80 will vary with the rate of the compacted straw core 18 being produced and will range between 360-400° Fahrenheit. The moisture level within the straw fiber 16 is important during the heating process, as the amount of moisture within the straw fiber 16 has a direct effect on the density and firmness of the fiberboard 10.

Figure 12:
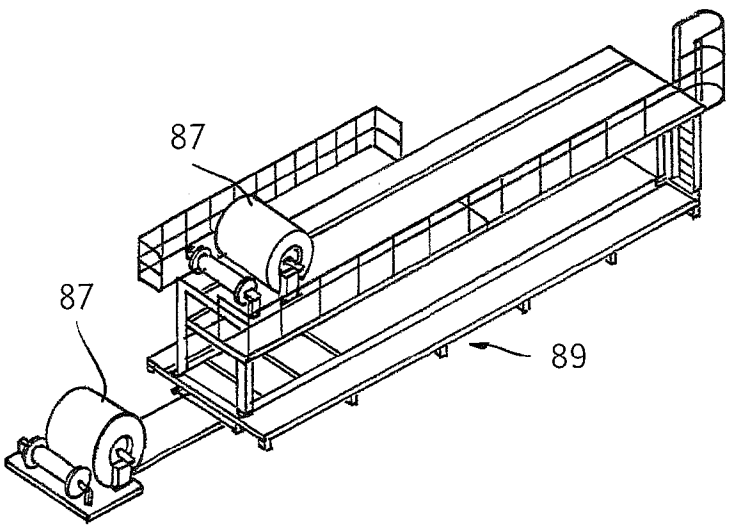
FIG. 12 is a perspective view of paper unwinders utilized in the improved method for making a compressed structural fiberboard of the present invention.

A second set of two heat platens 82 introduces more heat to the compacted straw core 18. A heavy-duty industrial construction paper 84, such as 69 lb. Kraft liner paper, is introduced from both the top and bottom openings of the heat platens 82 and is folded over the sides of the compacted straw core 18 through special side blocks that are also heated so as to enclose the compacted straw core 18 except for its ends. The paper 84 is guided from large rolls 87 of paper 84 through paper unwinders 89, as seen in FIGS. 4 and 12, and fife guides 85, as seen in FIG. 11. The Kraft liner paper 84 has its inner side coated with a dry glue, which is activated upon the application of heat. When heat is applied to the Kraft liner paper 84 by the heat platens 82, the dry glue on the Kraft liner paper 84 is activated so as to stick to the sides of the compressed straw core 18. The dry glue is an improvement over the previously-used flour and paste glue, which was applied to the Kraft liner paper 84 prior to wrapping the compacted straw core 18. The flour and paste application is a high-maintenance application that often provides inconsistent results.

Upon exiting the second set of heat platens 82, the wrapped compacted straw core 18 engages a set of pinch rollers 86 that slightly resist the forward movement of the compacted straw core 18 in order to control the density of the compacted straw core 18 and eliminate any surging of the compacted straw core 18 caused by the extruder 66. The pinch rollers 86 have variable drives 88 so as to control the rotational speed of the pinch rollers 86. By increasing the speed of the pinch rollers 86, the density of the compacted straw core 18 can be decreased, while decreasing the speed of the pinch rollers 86 will increase the density of the compacted straw core 18. The compacted straw core 18 is continuously monitored, and adjustments may be made to the rotational speed of the pinch rollers 86 to maintain a predetermined density of the compacted straw core 18. The pinch rollers 86 also assist in removing any surges of the compacted straw core 18 when an oscillating ram extruder 70 is utilized as the extruder 66.

Figure 13:
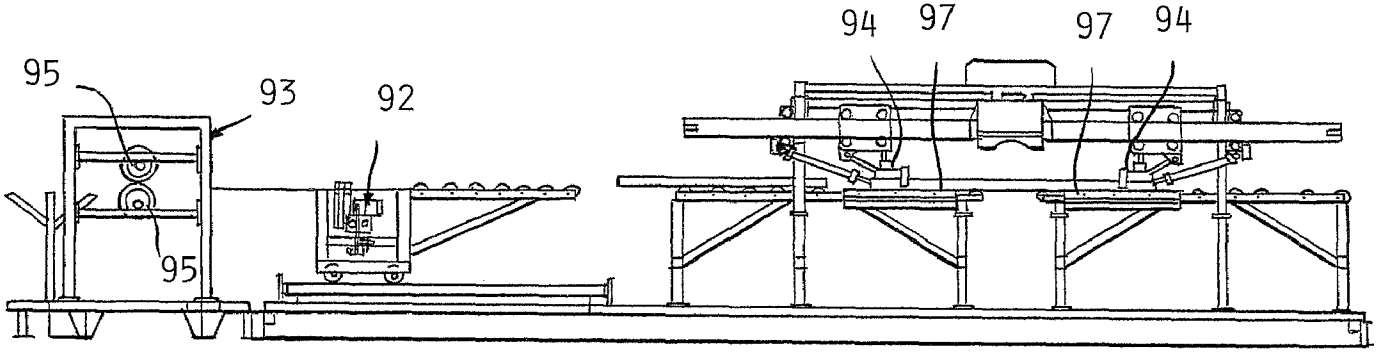
FIG. 13 is a side view of a saw cutter and end-capping machines utilized in the improved method for making a compressed structural fiberboard of the present invention.
Figure 14:
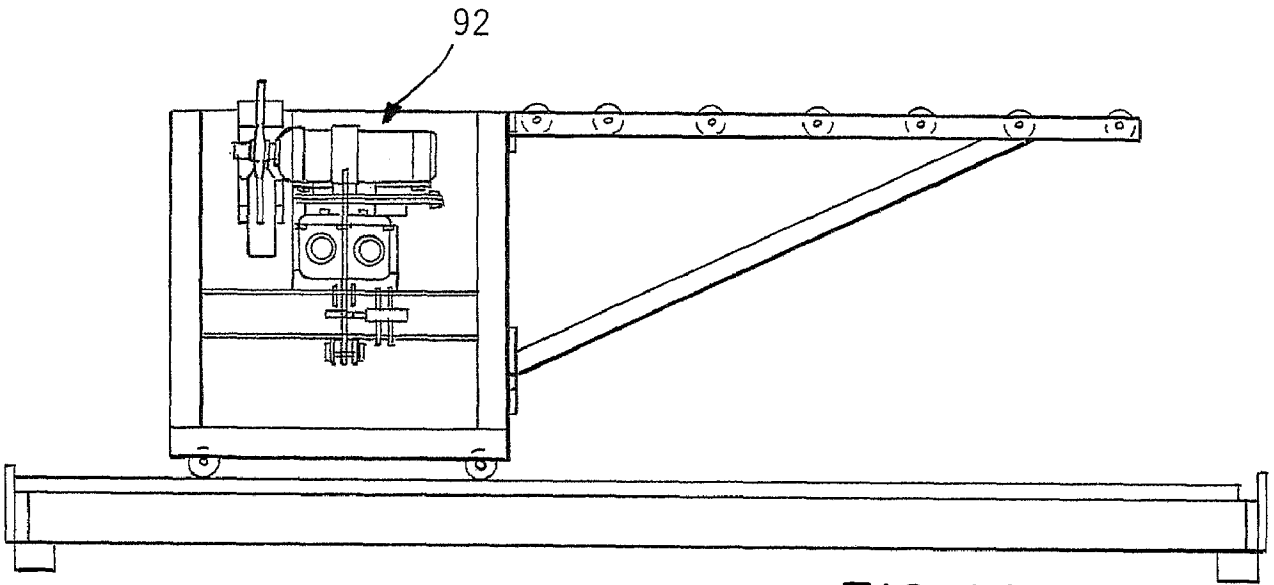
FIG. 14 is a side view of the saw cutter utilized in the improved method for making a compressed structural fiberboard of the present invention.

The paper wrapped compacted straw core 18 moves at a continuous length along a conveyor 90 to a cutoff saw 92, as seen in FIGS. 4 and 13-14. Prior to reaching the cutoff saw 92, the compacted straw core 18 passes through a board puller 93. The board puller 93 comprises a pair of opposing rollers 95 that are controlled by variable drives. As the compacted straw core 18 passes through the board puller 93, the board puller 93 works in conjunction with the pinch rollers 86 to control the speed of and eliminate any surges in the compacted straw core 18 caused by the extruder 66. The cutoff saw 92 cuts the compacted straw core 18 to a predetermined length set by a mill operator (not shown) at a central control panel (not shown). The cutoff saw 92 is moved at the same path rate as the compacted straw core 18 by monitoring the speed at which the wrapped compacted straw core 18 is exiting the extruder 66. The speed of the wrapped compacted straw core 18 is transmitted through an encoder to a servo drive to ensure that a square cut of the wrapped compacted straw core 18 is achieved.

Figure 15:
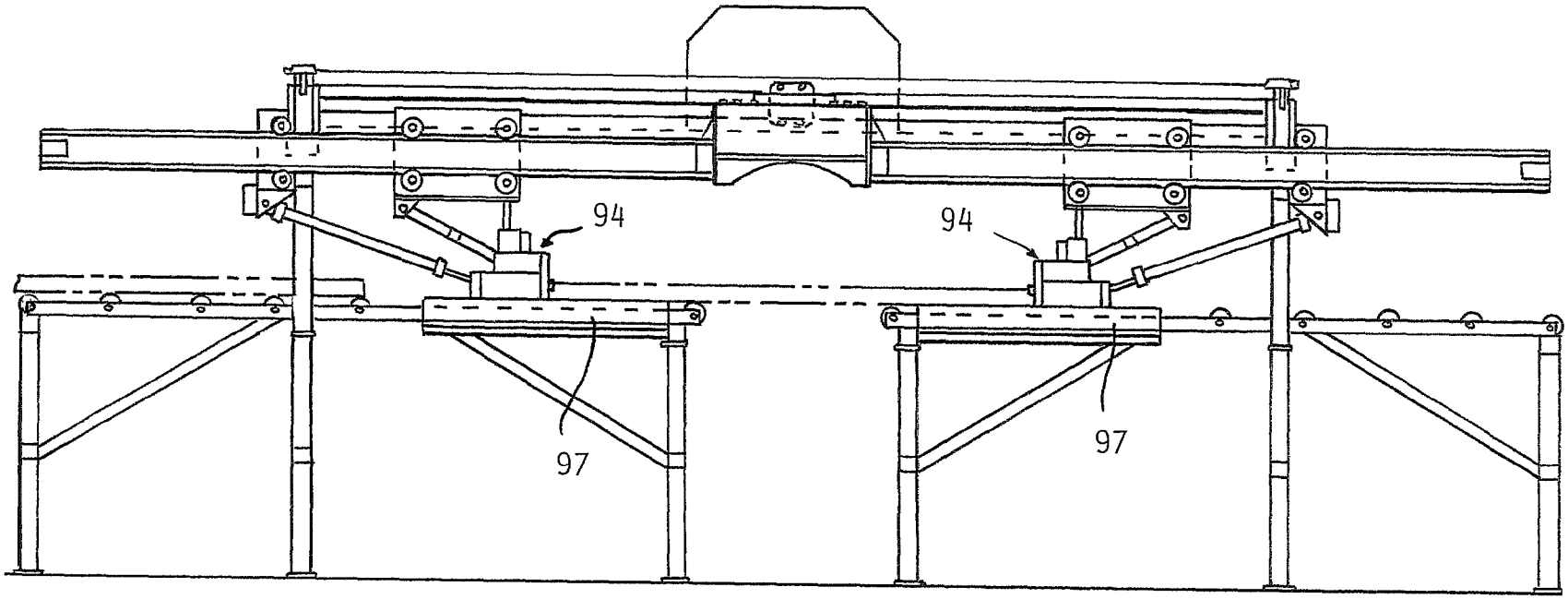
FIG. 15 is a side view of the end-capping machine and electronic weight scales utilized in the improved method for making a compressed structural fiberboard of the present invention.

As soon as the wrapped compacted straw core 18 is cut, the wrapped compacted straw core 18 is conveyed to an end cap machine 94, where the wrapped compacted straw core 18 is weighed by electronic scales in order to calculate the density and evaluate the quality of the fiberboard 10, as seen in FIGS. 4, 13, and 15. The wrapped compacted straw core 18 is then raised, and both ends of the wrapped compacted straw core 18 are capped with the 40 lb. Kraft liner paper 84 by means of dyes on each end of the end capping machine 94, which are heat-activated. When applying the paper end caps 84, the ends of the wrapped compacted straw core 18 are clamped with pressure and heated to avoid the flaring of the ends of the wrapped compacted straw core 18.

The entirely wrapped compacted straw core 18 is now a completed fiberboard 10 and is carried along conveyor belts 96, wherein the fiberboard 10 is carried along conveyor belts 96 and is allowed to cool. Electric fans (now shown) are pointed at the fiberboard 10 in order to blow air on the fiberboard 10 as it travels along the conveyor belts 96 so as to expedite the cooling of the fiberboard 10. In an alternative embodiment, other cooling methods are anticipated, such as the use of a refrigerated chamber (not shown). The fiberboard 10 may be allowed to pass through the refrigerated chamber, which further expedites the cooling of the fiberboard 10 as compared to the electric fans. By enhancing the efficiency of the cooling of the fiberboard 10, the conveyor belt 96 is shortened, thereby reducing the amount of space required for the mill 12. By decreasing the amount of space required for the mill, the amount of factory floor space required is reduced, thereby reducing the cost of factory floor space and enhancing the efficiency of the process.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. An improved method for making compressed structural fiberboard by extruding agricultural fibrous matter into said compressed structural fiberboard, wherein said improvement comprises the steps of:

providing a preselected volume of said agricultural fibrous matter;

preconditioning said agricultural fibrous matter to have a first predetermined moisture level within said agricultural fibrous matter;

separating and cleaning said agricultural fibrous matter;

adding steam to said agricultural fibrous matter until the moisture level within said agricultural fibrous matter reaches a second predetermined moisture level;

extruding said agricultural fibrous matter to form said compressed structural fiberboard; and tumbling said agricultural fibrous material within a tumbler, wherein said step of adding steam to said agricultural fibrous matter is performed therein.

2. The improved method, as stated in claim 1, wherein:

said first predetermined moisture level is 11%-15% by weight within said agricultural fibrous matter.

3. The improved method stated in claim 1, further comprising the steps of:

adding a predetermined level of borax to said steam to be applied to said agricultural fibrous matter to prevent the formation of bacteria in said agricultural fibrous matter and said compressed structural fiberboard.

4. The improved method stated in claim 1, wherein said step of separating and cleaning said agricultural fibrous matter further comprises the steps of:

separating said agricultural fibrous matter through the use of at least one flake separator;

separating foreign particles and waste from said agricultural fibrous material through the use of at least two straw walkers; and breaking down large pieces of said agricultural fibrous matter through the use of a shredder.

5. The improved method stated in claim 4, further comprising the steps of:

providing a vacuum system for collecting said foreign particles and waste from said agricultural fibrous matter when said foreign particles and waste are separated from said agricultural fibrous material.

6. The improved method stated in claim 5, further comprising the steps of:

recycling said separated foreign particles and waste and reintroducing said agricultural fibrous material into said method and utilizing said foreign particles and waste for other uses.

7. The improved method stated in claim 1, further comprising the steps of:

monitoring the moisture level within said agricultural fibrous material within said tumbler through the use of infrared moisture sensors mounted within said tumbler in order to adjust the amount of steam added to said agricultural fibrous matter to obtain said second predetermined level within said agricultural fibrous matter.

8. The improved method stated in claim 1, wherein said step of preconditioning said agricultural fibrous matter further comprises the steps of:

placing said agricultural fibrous matter in a moisture-removing device to lower the moisture level within said agricultural fibrous matter to said first predetermined moisture level.

9. The improved method stated in claim 1, wherein said step of preconditioning said agricultural fibrous matter further comprises the steps of:

air drying said agricultural fibrous matter at an ambient temperature until said agricultural fibrous matter reaches said first predetermined moisture level therein.

10. The improved method stated in claim 1, further comprising the steps of:

providing a screw extruder for extruding said agricultural fibrous material into said compressed structural fiberboard; and applying heat directly to said compressed structural fiberboard immediately after extruding said agricultural fibrous material.

11. The improved method stated in claim 1, further comprising the steps of:

carrying said agricultural fibrous matter on conveyors having variable drives for providing variable speeds of said conveyors;

sensing the level of said agricultural fibrous matter carried by said conveyors through the use of proximity switches; and adjusting the speed of said conveyors in response to signals sent by said proximity switches to said variable drives in response to the level of said agricultural fibrous matter provided by said conveyors.

12. The improved method stated in claim 1, further comprising the steps of:

wrapping said compressed fiber structural board with a containment material.

13. The improved method stated in claim 12, further comprising the steps of:

providing a dry glue-backed heavyweight paper stock as said containment material;

applying heat to said dry glue-backed heavyweight paper stock and said compressed structural fiberboard to activate the glue on said paper and assist in memorializing the shape of said compressed fiber structural board; and cooling said wrapped compressed fiber structural board.

14. The improved method stated in claim 13, wherein said step of cooling said wrapped compressed fiber structural board further comprises the steps of:

providing electrical fans for blowing ambient air on said compressed fiber structural board.

15. The improved method stated in claim 13, wherein said step of cooling said wrapped compressed fiber structural board comprises the steps of:

providing a refrigeration chamber for cooling said compressed fiber structural board.

16. The improved method stated in claim 12, further comprising the steps of:

providing a lightweight, high-strength mesh material as said containment material.

17. The improved method stated in claim 1, further comprising the steps of:

controlling the density of said compressed structural fiberboard by pulling said compressed structural fiberboard at variable rates after said step of extruding said compressed fiber structural board.

18. An improved method for making compressed fiber structural board by extruding agricultural fibrous matter into said compressed fiber structural board, wherein said improvement comprises the steps of:

providing a preselected volume of said agricultural fibrous matter;

preconditioning said agricultural fibrous matter to have a first predetermined level of moisture therein;

separating and cleaning said agricultural fibrous material from foreign particles and waste;

adding steam to said agricultural fibrous matter until said agricultural fibrous matter has a second predetermined level of moisture therein;

adding a predetermined level of borax to said agricultural fibrous matter to prevent the formation of bacteria in said agricultural fibrous matter and said compressed structural fiberboard;

carrying said agricultural fibrous matter on conveyors having variable drives for adjusting the speed of said conveyors;

sensing the amount of said agricultural fibrous matter being carried by said conveyors and providing a signal to said variable drives to adjust the speed of said conveyors in order to provide a predetermined amount of said agricultural fibrous matter; and extruding said agricultural fibrous matter to form said compressed structural fiberboard.

19. The improved method stated in claim 18, wherein the step of said separating and cleaning said agricultural fibrous matter further comprises the steps of:

separating said agricultural fibrous matter through the use of at least one flake separator;

separating foreign particles and waste from said agricultural fibrous matter through the use of at least two straw walkers;

breaking down large pieces of said agricultural fibrous matter through the use of a shredder; and vacuuming foreign particles and waste from said agricultural fibrous matter when such foreign particles and waste are separated from said agricultural fibrous matter.

20. The improved method stated in claim 18, further comprising the steps of:

providing a tumbler for tumbling said agricultural fibrous matter, housing said adding of said steam, and housing said adding of said borax; and providing infrared sensors within said tumbler for monitoring the level of moisture within said agricultural fibrous material and adjusting the amount of steam added to agricultural fibrous matter within said tumbler.

21. An improved method for making compressed structural fiberboard by extruding fibrous matter into said compressed structural fiberboard, wherein said improvement comprises the steps of:

providing separated and clean agricultural fibrous matter;

tumbling said agricultural fibrous material within a tumbler;

adding steam to said agricultural fibrous material within said tumbler until the moisture level reaches a predetermined level; and forming said compressed structural fiberboard from said agricultural fibrous material.

* * * * *